United States Patent [19]

Mezei

[11] 4,036,125

[45] July 19, 1977

[54] TRAILER MOUNTED AUTOMOBILE CRUSHER

[76] Inventor: John R. Mezei, 3940 Knapp NE., Grand Rapids, Mich. 49505

[21] Appl. No.: 649,750

[22] Filed: Jan. 16, 1976

[51] Int. Cl.[2] ..... B30B 3/02

[52] U.S. Cl. ..... 100/100; 100/210; 100/269 R; 100/DIG. 1

[58] Field of Search ..... 100/100, 210, DIG. 1, 100/DIG. 2, 269 R; 144/282; 425/374

[56] References Cited

U.S. PATENT DOCUMENTS

| | | | |
|---|---|---|---|
| 1,650,758 | 11/1927 | Kukla | 425/374 |
| 1,798,555 | 3/1931 | Pipkin | 100/210 X |
| 2,353,221 | 7/1944 | Clifton | 100/DIG. 1 |
| 3,237,554 | 3/1966 | Davis | 100/DIG. 1 |
| 3,377,946 | 4/1968 | Garland | 100/DIG. 1 |
| 3,489,078 | 1/1970 | Oberhellmann | 100/DIG. 1 |
| 3,796,151 | 3/1974 | Williams | 100/DIG. 1 |
| 3,840,134 | 10/1974 | Luscombe | 100/210 X |
| 3,844,209 | 10/1974 | Allbritton | 100/100 |
| 3,855,917 | 12/1974 | Farrell | 100/210 X |
| 3,859,910 | 1/1975 | Swanson | 100/100 |

FOREIGN PATENT DOCUMENTS

| | | | |
|---|---|---|---|
| 227,861 | 6/1963 | Austria | 100/210 |

*Primary Examiner*—Billy J. Wilhite

*Attorney, Agent, or Firm*—Price, Heneveld, Huizenga & Cooper

[57] ABSTRACT

An automobile crusher which is readily adaptable for trailer mounting includes a reinforced elongated bed, a crushing roller positioned transversely of the reinforced bed and a hydraulic piston/cylinder arrangement for powering the crushing roller down the length of the bed and over an automobile or the like. A side plate arrangement secured to the roller limits the vertical movement of the roller relative to the bed. The crusher flattens vehicle bodies and the like by the weight of the roller and by forcing the automobile through the limited vertical space between the roller and the reinforced bed.

13 Claims, 8 Drawing Figures

TRAILER MOUNTED AUTOMOBILE CRUSHER

BACKGROUND OF THE INVENTION

This invention relates to automobile crushers and, more particularly, to a unique roller type crusher wherein the automobile body is crushed by the weight of the roller and by forcing or wedging the body through an area of reduced height.

Various forms of automobile crushers are known in the prior art. The crushers have generally been developed to reduce the height of the vehicles so that more junked cars may be loaded onto a truck or the like for transport to a recycling plant. Further, the automobiles must be preflattened prior to insertion within a shredder at the recycling plant.

One form of prior crusher is commonly referred to as a flattening press. With this arrangement, the automobile or other object to be crushed is placed between a downwardly swinging, crushing head and a support bed or anvil. This crusher relies on the weight of the crushing head which violently impacts on the automobile for the flattening action. These flattening presses generally require multiple or successive impacts by the head in order to reduce the vertical height of the automobile to the desired level. The explosive impact on the automobile can result in injury to an operator or other personnel in the general area of the crusher since shrapnel-like material may fling off into the surrounding area.

A need exists for a relatively simple mobile device for crushing automobiles and the like for transportation purposes and for pre-flattening of the bodies prior to insertion in a shredder, whereby the problems heretofore experienced are substantially alleviated.

SUMMARY OF THE INVENTION

In accordance with the present invention, a unique crusher for flattening automobile bodies and the like is provided. Essentially, the automobile crusher includes a reinforced, elongated bed and a crushing roller positioned perpendicular to the length of the bed. Means are provided for powering the roller along the length of the bed and over an automobile body and the like to be crushed. Further, provision is made to limit the vertical movement of the roller relative to the bed during the crushing action. The automobile body, therefore, is flattened under the combined crushing action of the weight of the roller and the wedging action as the automobile is in effect forced through the limited vertical space between the roller and the reinforced bed.

DETAILED DESCRIPTION OF THE PREFERRED EMBODIMENT

Figure 1:
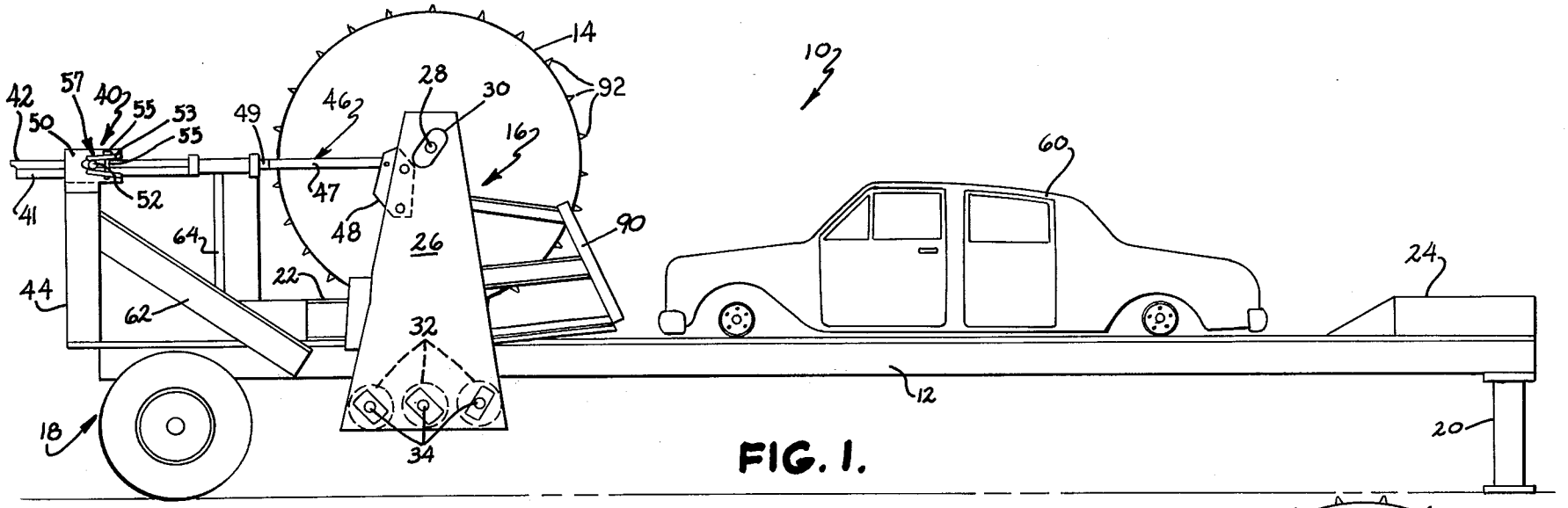
FIG. 1 is a side, elevational view of an automobile crusher in accordance with the present invention.
Figure 2:
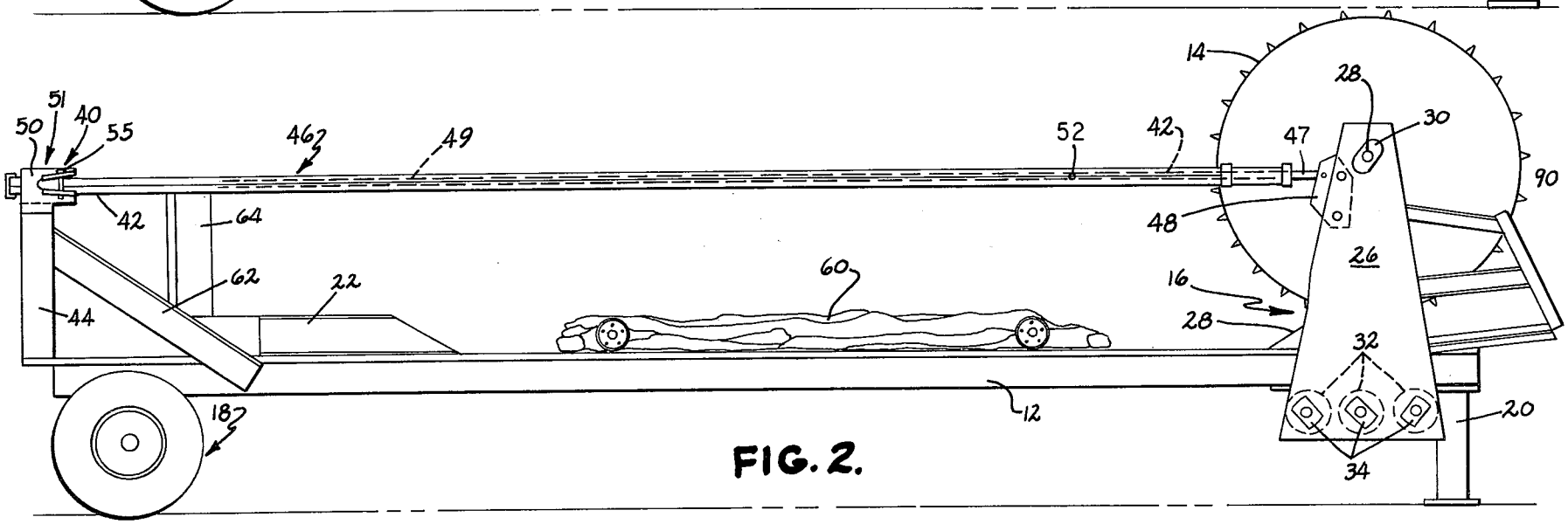
FIG. 2 is a side, elevational view of the automobile crusher of FIG. 1 with the roller fully extended and the cylinder arrangement positioned for highway transport.
Figure 3:
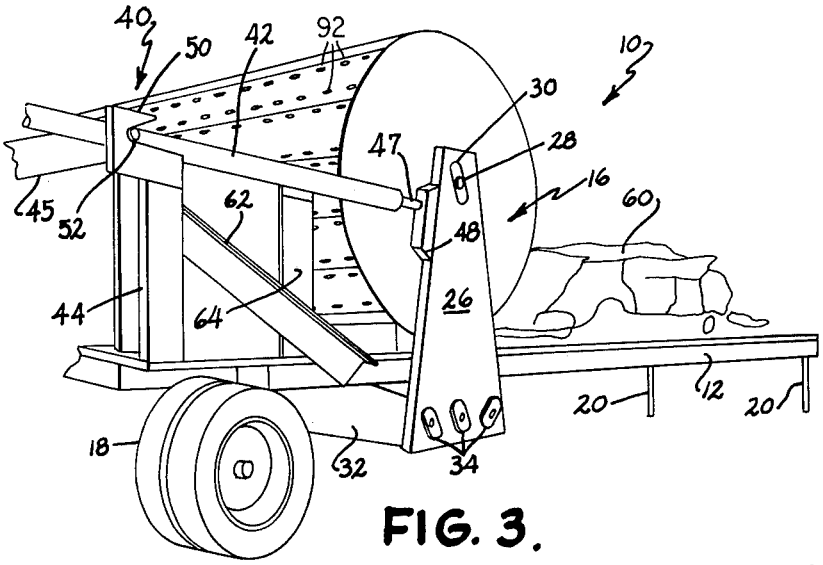
FIG. 3 is a fragmentary, perspective view of the automobile crusher.

With reference to the drawings, FIGS. 1, 2 and 3 illustrate the overall structural arrangement of an automobile crusher in accordance with the present invention. The automobile crusher is generally designated 10 and includes an elongated, reinforced supporting bed or crushing platform 12, a crushing roller 14 and a vertical movement limiting arrangement 16. The roller is positioned transversely of the bed 12 or perpendicular to the length of the bed. As shown, the reinforced bed 12 may take the form of a conventional flatbed semitrailer. The trailer bed is preferably modified through the use of reinforcing steel plates across the top of the bed and additional structural members along the undersurface of the bed. When in use, the bed 12 in the mobile configuration is supported at one end by an axle/wheel arrangement 18 and at the other end by suitable jacks 20. A ramp 22 is provided at the rear end of the bed 12. The roller 14 is positioned on the ramp 22 prior to commencement of the crushing operation. Another ramp 24 is positioned on the bed 12 adjacent the forward end thereof. The ramp 24 positions the roller 14 for storage during transportation, as will be more fully explained below.

The limiting arrangement 16 includes a pair of spaced side plates 26 positioned at opposite ends of roller 14. The side plates rotatably receive the roller 14 through apertures formed in the upper ends thereof. The shaft or axle 28 of the roller 14 is retained by a retainer assembly 30. The side plates 26 extend downwardly from the roller axle 28 to a point below the bed 12. A plurality of limiting rollers 32 extend underneath the bed 12 and interconnect the lower ends of the side plates 26. The rollers are secured to the side plates by suitable retainers 34. The plates 26 are dimensioned so as to limit the vertical spacing or movement between the roller 14 and the bed 12 during the crushing operation. As will be more fully described below, when the roller 14 is powered over an automobile, the limiting rollers 32 will ride on the undersurface of the support bed 12 thereby limiting the vertical movement of the main crushing roller 14. Forwardly directed side plate extensions or guides 90 may be attached to each side plate 26 (FIGS. 1 and 2). These extensions serve to retain the automobile or the like 60 in line with the roller 14 during the crushing operation.

Means are provided in the form of a pair of piston/-cylinder assemblies 40 for powering or rolling the crushing roller 14 the length of the bed 12. Each piston/cylinder assembly 40 includes a cylinder 42 supported on top of an upright stanchion 44 which is secured to the bed 12. Since the cylinders are selectively slidable to a transport position as described below, it is preferred that steel channel members 39, 41 be secured to the exterior of the cylinder for protection purposes. A piston rod assembly 46 is pivotally connected to each side plate 26 through a bracket 48. The piston rod assembly 46 is preferably of two part construction including an end piece 47 and a piston connected piece 49. During operation of the crusher, the end of the rod assembly 46 may be permanently deformed. If such should happen, only portion 47 need be replaced, greatly reducing the cost of and increasing the ease of repair.

As an additional reliability feature, it is preferred that the forward ends of the cylinder be positioned behind the crusher roller as seen in FIG. 1. Upon rocking action, the more flexible piston rod assembly will be permitted to deflect. This mounting arrangement therefore reduces the chance of twisting or bending of the cylinders during crusher operation.

Figure 6A:
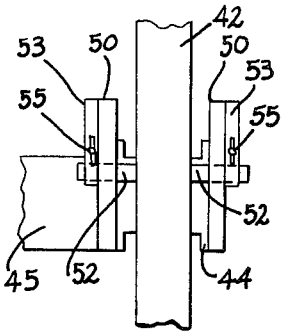
FIG. 6*a* is a fragmentary, plan view showing the cylinder retaining the structure of the present invention.
Figure 6B:
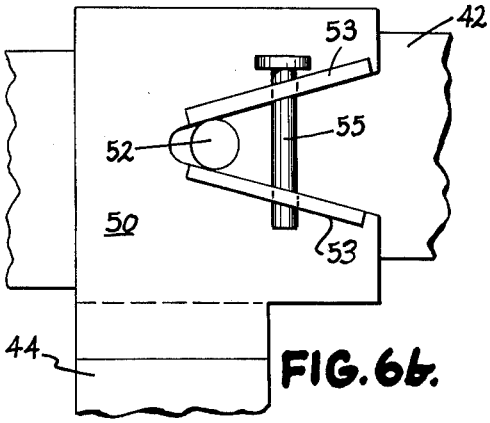
FIG. 6*b* is an enlarged, fragmentary, side elevational view of the retaining structure.

Each stanchion 44 is preferably a steel girder. As best seen in FIGS. 1, 2, 6*a* and 6*b,* each cylinder assembly 42 rests on top of one of the stanchions. A pair of retainer plates 50 are welded or otherwise secured to the top of the stanchion 44 on either side of the cylinder. Each plate 50 is formed with a forwardly opening, V-shaped notch 51. A pair of vertically spaced flanges 53 are positioned along the lateral edges of the notch 51. Each cylinder assembly includes a pair of outwardly directed studs 52. The studs 52 are receivable within the notches of each plate 50. A pin 55 of suitable high strength steel is insertable through apertures in the flanges at a point forward of the base of the notch (FIGS. 1, 6*a* and 6*b*).

During extension of the piston, the reactive force wedges the studs 52 within the V-shaped notches and the roller 14 is powered forward over an automobile 60. With the pins 55 in place, the piston can be retracted back into the cylinder and the reactive force will be exerted against the pins. With the pins removed and the roller 14 blocked on the forward ramp, the cylinders will then slide forwardly on the stanchions over their piston rod assemblies. The bed is dimensioned so that the cylinders will be positioned within the general dimensions of the trailer for highway transport. This positioning is best seen in FIG. 2. The plates 50 also provide lateral stability to the cylinders and guide the cylinders as they slide to their transport positions.

The upright stanchions 44 are braced by suitable diagonal members 62 which extend between the stanchions 44, the bed 12 and the ramp 22. Suitable vertical members 64 may be positioned adjacent the rear portion of the ramp 22. These vertical members and suitable cross pieces may serve as a stop for the roller 14 when it is positioned on the ramp 22 and also as an attachment point for the various components of a hydraulic control system.

Figure 7:
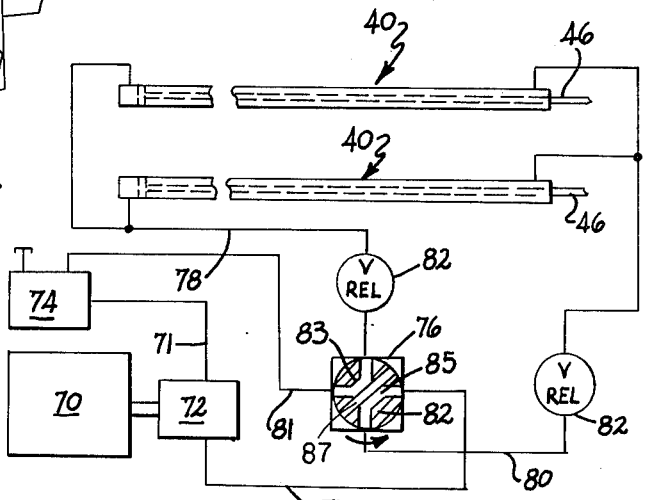
FIG. 7 is a schematic of the hydraulic control system and power means employed with the present invention.

One form of hydraulic control system suitable for use with the power drive means 40 is illustrated in FIG. 7. As shown therein, a suitable source of power such as a conventional internal combustion engine 70 is provided to drive a hydraulic pump 72. Hydraulic fluid is pumped from a reservoir 74 to a conventional reversing valve 76 via line 71. The valve is of a two position, four port type and selectively directs pressurized, hydraulic fluid to either a line 78 or a line 80. Line 78 directs hydraulic fluid to the rear end of each piston/cylinder assembly 40 for extension of the piston rods 46. Line 80 directs fluid to the front end of the cylinders for retraction of the rods 46. Pressure relief valves 82 may be inserted within lines 78, 80 as a safety measure. The engine, pump and valve assemblies may be suitably mounted at the rear of the bed.

The control system further includes a line 81 which is a return line to the reservoir 74. The reversing valve 76 includes a pair of passages 83, 85 formed in a rotatable valve element 87.

In the position shown in FIG. 7, hydraulic fluid is directed under pressure from pump 72 through line 71, passage 85 and line 80 to retract the piston or to move the cylinders to their forward transport positions. The fluid located behind the pistons during this operation is forced through line 78, valve passage 83 and return line 81 to the reservoir 74.

By rotating the valve element through a 90° angle, pressurized fluid is directed through line 71, passage 85 and line 78 to the rear end of the cylinders thereby extending the piston rods. Fluid in front of the piston is drained through line 80, valve passage 83 and line 81 to the reservoir.

Figure 4:
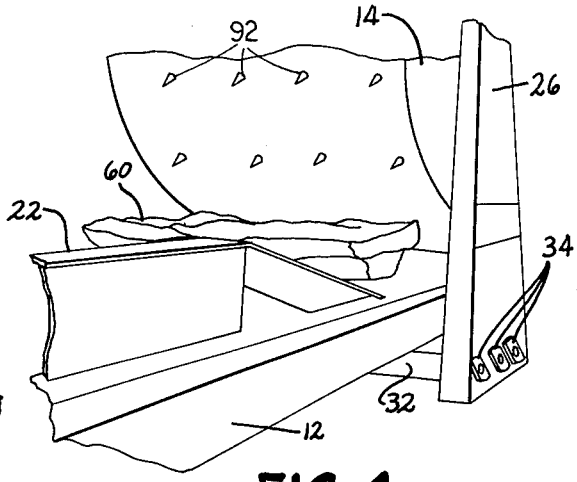
FIG. 4 is a partial, fragmentary view showing the positioning of the roller after the crushing operation has commenced.
Figure 5:
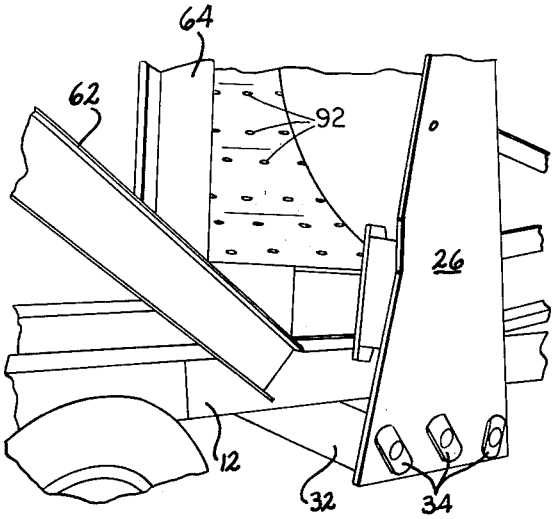
FIG. 5 is a partial, fragmentary perspective view of the ramp portion of the car crusher in accordance with the present invention.

In operation, an automobile or the like 60 to be crushed or flattened is placed intermediate the ends of the support bed 12. The roller 14 is initially positioned on the ramp 22. Upon actuation of the hydraulic control system and the piston/cylinder assemblies 40, the roller 14 is moved down off the ramp and forwardly toward the car 60 (FIGS. 4 and 5). As best seen in FIGS. 3, 4 and 5, the roller is provided on its peripheral surface with a plurality of projections or lugs 92. As the roller engages the car 60, these lugs provide sufficient traction for the rolling action and also in effect force or wedge the car into the limited vertical space between the roller 14 and the bed 12. As the roller 14 traverses the car 60, the height limiting rollers 32 engage the undersurface of the bed. As best seen in FIG. 2, once the roller 14 has traversed the length of the bed 12 the car structure 60 has been sufficiently flattened. Since the vertical spacing between the roller 14 and the bed 12 is limited, the weight of the roller is reduced from that needed to crush a car without this feature. Also, no violent impacting of the car occurs during operation of the crusher.

In a typical installation, the support bed would be approximately 38 to 39 feet in length and have a width of approximately 7 feet. A typical crusher roller 14 would take the form of a ¼ inch steel drum filled with concrete to obtain the desired weight and having a diameter of approximately 7½ feet. The piston/cylinder assemblies 40 have been found to be adequate with a 7 inch cylinder and a 5½ inch piston rod or shaft. Approximately 21 feet of travel insures proper crushing or flattening of the vehicle 60. The side plates and height limiting rollers should be dimensioned so that the final crushed height of the automobile would be approximately 8 to 12 inches.

As previously discussed, when the automobile crusher in accordance with the present invention is mounted on a flatbed truck, the arrangement is readily adaptable for highway transportation by moving the roller 14 to the forward ramp 24. Once positioned on the ramp 14 the roller would be blocked, the pins 55 removed and hydraulic fluid would be directed to the forward end of the cylinders. Due to the manner in which the cylinders 42 are retained on the stanchions 44, the cylinders will move in a forward direction on the rods 46. The studs 52 are readily movable out of the V-shaped notches 50. As a result, the entire automobile crusher assembly will be suitably positioned within the dimensions of the flatbed truck employed for transportation.

This mobile feature of the crusher permits the apparatus to be moved around to smaller junk yards for operation. The smaller wrecked car concerns usually cannot justify the expense of an "on site" crusher. The retaining arrangement of the cylinders coupled with the truck mounting provides a normal transport of the crusher and allows the smaller concerns to have relatively inexpensive access to a crusher. The owner of the crusher is also able to recover some or all of the cost of the crusher when providing this service.

As will now be readily apparent, the crusher in accordance with the present invention could take the form of a stationary facility. In such case, a suitable trench could be dug and a reinforced steel bed would be placed over the trench. The operative portions of the crusher would remain the same.

It can therefore be seen that various modifications to the crusher in accordance with the present invention will become apparent to one of ordinary skill in the art. As expressly intended, therefore, the above description should be considered as that of the preferred embodiment only. The true spirit and scope of the present invention will be determined by reference to the appended claims.

The embodiments of the invention in which an exclusive property or privilege is claimed are defined as follows:

1. A vehicle crusher for flattening automobiles or the like comprising:

a reinforced, elongated bed;

a crushing roller positioned on and perpendicular to the length of said bed and mounted for vertical movement relative thereto during crushing;

means operatively connected to said roller for powering the roller along the length of the bed; and means extending below and connected to the roller and movable vertically with said roller for limiting the vertical movement of said roller from said bed as said roller is powered down the bed and over a vehicle to be crushed.

2. A vehicle crusher as defined by claim 1 wherein said vertical movement limiting means comprises:

a pair of slide plates disposed at opposite ends of said roller, said roller being rotatably connected to said side plates; and at least one height limiting member extending between said side plates and underneath said bed in a normally spaced relationship with said bed and contacting said bed during crushing.

3. A vehicle crusher as defined by claim 2 further including a plurality of lug-like projections attached to the exterior, peripheral surface of said crushing roller for increasing the tractive force between said roller and the automobile to be crushed and for in effect forcing the automobile through the limited vertical space between the roller and the bed.

4. A vehicle crusher as defined by claim 3 wherein said height limiting member comprises:

a limiting roller rotatably secured at each end to said side plates.

5. A vehicle crusher as defined by claim 1 further including a wheel/axle arrangement secured to the underside of said bed permitting transport of the crusher.

6. A vehicle crusher for flattening automobiles or the like comprising:

a reinforced, elongated bed;

a crushing roller positioned on and perpendicular to the length of said bed; means operatively connected to said roller for powering the roller along the length of the bed; and means connected to the roller for limiting the vertical movement of said roller from said bed as said roller is powered down the bed and over a vehicle to be crushed, said vehicle crusher further including a pair of vertical stanchions mounted at opposite points at the rear of said bed and wherein said powering means comprises:

a piston/cylinder assembly supported on one of said stanchions and including a piston rod operatively connected at its outer end to said roller;

another piston/cylinder assembly supported on the other of said stanchions and including a piston rod operatively connected at its outer end to said roller; and retaining means secured to said stanchions for restraining rearward movement of said cylinders when said piston rods are extended but selectively permitting forward, sliding movement of said cylinder for storage when said roller is at the end of said bed opposite said stanchions.

7. A vehicle crusher as defined by claim 6 further including a hydraulic control means for extending and retracting said piston/cylinder assemblies.

8. A vehicle crusher for flattening automobiles or the like comprising:

a reinforced, elongated bed;

a crushing roller positioned on and perpendicular to the length of said bed;

means operatively connected to said roller for powering the roller along the length of the bed; and means connected to the roller for limiting the vertical movement of said roller from said bed as said roller is powered down the bed and over the vehicle to be crushed, said vertical movement limiting means comprising:

a pair of side plates disposed at opposite ends of said roller, said roller being rotatably connected to said side plates; and at least one height limiting member extending between said side plates and underneath said bed, said vehicle crusher further including a plurality of lug-like projections attached to the exterior, peripheral surface of said crushing roller for increasing the tractive force between said roller and the automobile to be crushed and for in effect forcing the automobile through the limited vertical space between the roller and the bed, and said crusher further including a pair of vertical stanchions mounted at opposite points at the rear of said bed and wherein said powering means comprises:

a piston/cylinder assembly supported on one of said stanchions and including a piston rod operatively connected at its outer end to said roller;

another piston/cylinder assembly supported on the other of said stanchions and including a piston rod operatively connected at its outer end to said roller; and retaining means secured to said stanchions for restraining rearward movement of said cylinders when said piston rods are extended by selectively permitting forward, sliding movement of said cylinders for storage when said roller is at the end of said bed opposite said stanchions.

9. A vehicle crusher as defined by claim 8 wherein each of said cylinders includes horizontally positioned, outwardly directed studs adjacent their forward ends and wherein said restraining means comprises:

a pair of restraining plates secured to each of said stanchions on opposite sides of each of said cylinders, each restraining plate having a forwardly opening notch dimensioned so as to receive one of said studs;

a pair of outwardly directed flanges mounted on said plates adjacent the upper and lower lateral edgs of said notch, said flanges each having vertically aligned apertures therein; and a pair of removable restraining pins, one extending through each of the vertically aligned flange apertures.

10. A vehicle crusher as defined by claim 9 further including a hydraulic control means for extending and retracting said piston/cylinder assemblies, said control means comprising:

a source of fluid under pressure including a reservoir tank;

a two position, four port reversing valve having a first port connected to said pressurized fluid source, a second port connected to said reservoir, a third port connected to the rear end of each of said cylinders and a fourth port connected to the forward end of each of said cylinders, whereby when said valve is in one position pressurized fluid is directed to the rear of said cylinders to extend said piston rods and when said valve is in another position pressurized fluid is directed to the front of said cylinders to retract said piston rods.

11. A vehicle crusher as defined by claim 10 further including a wheel axle arrangement secured to the underside of said bed permitting transport of the crusher.

12. A vehicle crusher as defined by claim 11 wherein said height limiting member comprises:

a limiting roller rotatably secured at each end to said side plates.

13. A vehicle crusher for flattening automobiles or the like comprising:

reinforced, elongated bed;

a crushing roller positioned on and perpendicular to the length of said bed;

means operatively connected to said roller for powering the roller along the length of the bed; and means connected to the roller for limiting the vertical movement of said roller from said bed as said roller is powered down the bed and over a vehicle to be crushed; said vertical movement limiting means comprising:

a pair of side plates disposed at opposite ends of said roller, said roller being rotatably connected to said side plates; and at least one height limiting member extending between said side plates and underneath said bed, said crusher further including a plurality of lug-like projections attached to the exterior, peripheral surface of said crushing roller for increasing the tractive force between the roller and the bed, and wherein said height limiting member comprises:

a limiting roller rotatably secured at each end to said side plates and said vehicle crusher further includes a forwardly directed side plate extension secured to each of said side plates.

* * * * *